United States Patent [19]

Isham

[11] Patent Number: 4,672,702

[45] Date of Patent: Jun. 16, 1987

[54] ARTICLES OF BEDDING WITH STRETCH FIT ENDS

[76] Inventor: Barbara K. Isham, 13118 Kimberly, Houston, Tex. 77079

[21] Appl. No.: 682,345

[22] Filed: Dec. 17, 1984

[51] Int. Cl.[4] ..... A47G 9/04

[52] U.S. Cl. ..... 5/497; 5/499

[58] Field of Search ..... 5/482, 495–497, 5/499–502; 297/219, 224

[56] References Cited

U.S. PATENT DOCUMENTS

| | | | |
|---|---|---|---|
| 2,639,444 | 5/1953 | Monsabert . | |
| 3,144,666 | 8/1964 | Mazera et al. . | |
| 3,906,559 | 9/1975 | Bahr . | |
| 3,962,739 | 6/1976 | Crockett . | |
| 4,021,869 | 5/1977 | Root . | |
| 4,266,308 | 5/1981 | Shatz | 5/494 |
| 4,279,045 | 8/1981 | Vitale | 5/497 |
| 4,384,380 | 5/1983 | Glaha et al. | 5/485 |

*Primary Examiner*—Gary L. Smith
*Assistant Examiner*—Michael F. Trettel
*Attorney, Agent, or Firm*—Arnold, White & Durkee

[57] ABSTRACT

A bedding article for covering a mattress comprising a substantially rectangular panel that covers the top and sides of the mattress and at least one stretch fit end that engages one end of the mattress. The rectangular panel has opposed head and foot ends and also has at least two substantially rectangular cutouts at the corners of the foot end that form first edges non-parallel to the foot end and second edges parallel to the foot end. The stretch fit end is formed by a rectangular panel of stretchable material attached along one long edge to the foot end, and first edges of the substantially rectangular panel, the short edges are then attached to the second edges such that a box-like foot end is formed.

9 Claims, 6 Drawing Figures

ARTICLES OF BEDDING WITH STRETCH FIT ENDS

STATEMENT OF THE INVENTION

This invention relates generally to articles of bedding such as sheets, blankets, mattress covers and the like. In particular, the invention relates to bedding articles having novel stretch fitted ends.

BACKGROUND OF THE INVENTION

The problems and annoyances of bed making are well known. These problems are particularly acute for children, older people and the handicapped. To properly place a standard fitted sheet on a mattress, at least one corner of the mattress usually must be lifted to stretch the corner of the fitted sheet over the corner of the mattress. Similarly, to properly place a flat top sheet or blanket on a mattress, the foot end of the mattress must be lifted to allow the sheet or blanket to be folded under the mattress. As a result of this need for lifting a heavy unwieldy mattress, the everyday task of bed making is beyond the capabilities of many people. These problems are aggrevated by variations in the size of both mattresses and bedding articles.

In addition to problems attendent to bed making, conventional bedding also suffers deficiencies in its ability to remain in place while the bed is in use. This is particularly true of flat top sheets and of blankets.

A variety of solutions have been tried to remedy these problems. For example, U.S. Pat. No. 3,962,739 describes a top and bottom sheet sewn together to an elastic strip at one end with a second elastic strip sewn to the bottom sheet at the opposite end. U.S. Pat. No. 4,021,869 discloses a bed covering having a pocket formed at one end and elastic strips designed to fit around the head portion of the mattress. U.S. Pat. No. 2,639,444 describes a mattress cover having stretch sides and end panels. The mattress cover completely encases the mattress. Probably, to date, the most accepted solution to these problems is the standard fitted sheet.

As will be seen, none of these attempts solve all of the problems associated with bedding. For example, some lessen the problems with movement of the bedding while in use, but aggrevate the problems associated with bed making. The present invention solves these problems in a novel and unique manner.

SUMMARY OF THE INVENTION

This invention is directed to bedding articles for use with a mattress. The bedding article is comprised of a fabric panel of a shape substantially congruent to that of the upper surface of the mattress. At at least one end of the fabric panel, a rectangular stretch panel is attached to the fabric panel along one side, and at each end of the rectangular stretch panel so as to form a box-like construction defined on the top and each side by the fabric panel and on the end by the rectangular stretch panel. The stretch panel extends a nominal distance beyond each corner of the box-like construction. An elastic band is attached along the free side of the stretch panel.

DETAILED DESCRIPTION

Figure 1:
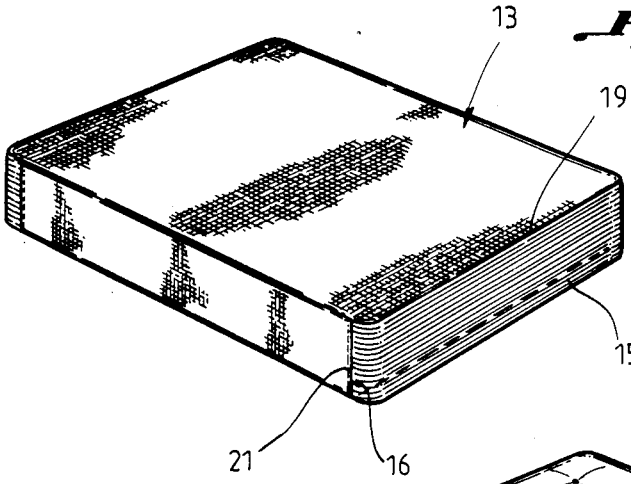
FIG. 1 is a view of a bottom or lower bed sheet in place on a mattress.
Figure 2:
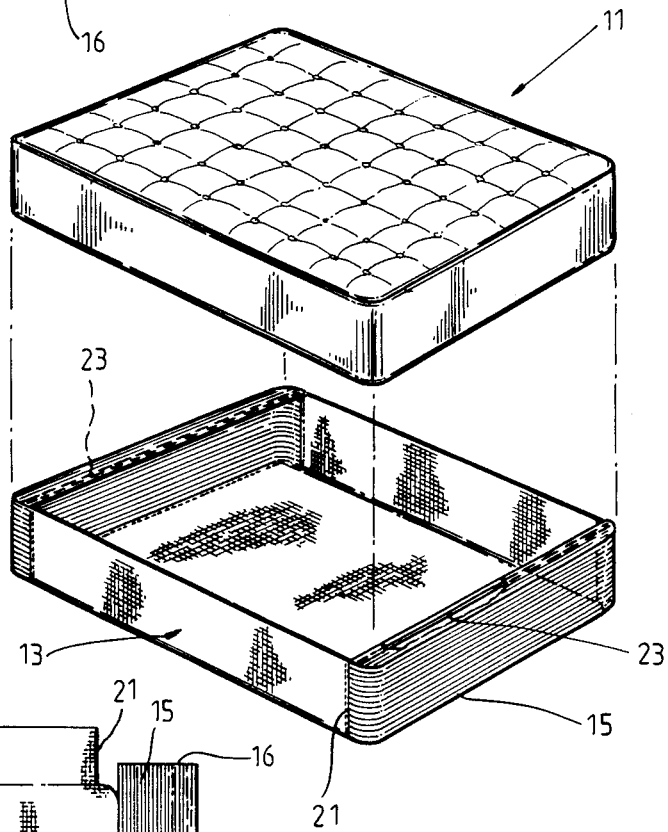
FIG. 2 is an exploded view of a bottom bed sheet and mattress viewed from below.
Figure 3:
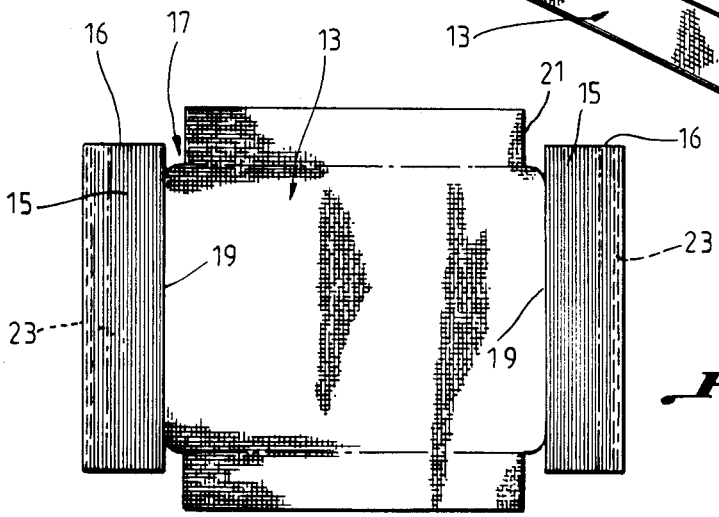
FIG. 3 is an illustration of the shape of the fabric panel and the stretch panel prior to attachment of the ends of the stretch panels to the fabric panel.

Referring to FIGS. 1–3, the construction of a bottom sheet and the manner in which it fits over a mattress 11 is illustrated. A fabric panel 13 is cut so as to be substantially congruent to the shape of the upper surface of the mattress 11. The width of the fabric panel for a bottom sheet will be approximately two to six inches more than the combined distance of the width of the mattress plus two times the depth of the mattress. The fabric panel can be of any fabric suitable for use as sheeting such as cotton or cotten-polyester blends.

Still referring to FIGS. 1–3, a rectangular stretch panel 15 is attached to the foot and head ends of the fabric panel along one side and at each end of the rectangular stretch panel. The panel is sized so that its depth is somewhat greater than the depth of the mattress, usually two to five inches, and its width nominally exceeds the width of the mattress, typically by four to ten inches. Referring to FIG. 3, the shape of a bottom sheet is shown prior to its attachment to the stretch panels. Substantially rectangular cutouts 17 are formed in each corner of the fabric panel 13. The cutouts extend inward from the fabric panel edges for a distance approximately equal to the depth of the rectangular stretch panel. The dimension of the cutouts from the head and foot ends of the fabric panel should be typically two to five inches, and as will be explained further below, should be substantially equal to one-half the distance by which the stretch panel 15 to be attached to the fabric panel exceeds the width of the mattress.

Referring to FIGS. 1–3, one side of the rectangular stretch panel is sewn to the fabric panel at edge 19. The word sewn is used herein for convenience and should be interpreted to include other suitable forms of attachments such as gluing, taping, heat sealing and the like. The rectangular stretch panel is also attached along each end 16 to edge 21 of the cutout 17. As can be seen in FIGS. 1 and 2, this mode of attachment yields a box-like construction at each end of the sheet. The upper and two sides of the box are defined by the fabric panel 13 and the end of the box as defined by stretch panel 15. As is seen in FIGS. 1 and 2 and as alluded to above, the stretch panel exceeds the width of the mattress and extends for a nominal distance beyond the corners formed by its attachment to panel 13. This extension of the stretch panel aids the box-like construction of a sheet in shaping itself to the ends of the mattress and thereby holding the sheet in position. Typically, the stretch panel will extend beyond the corners for about two to about five inches. About three inches is preferred.

The stretch panels can be any material having sufficient elasticity to aid in fitting the box ends of the bedding to the mattress. In the case of sheets such as described above, a stretch fabric such as stretch terry cloth is preferred. However, a variety of other stretch fabrics are suitable as would be non-woven stretch materials such as various rubbers and other polymeric materials. In the case of stretch fabrics, such fabrics are, typically, primarily elastic in only one direction, i.e., the stretch property is confined to a single direction and the material exhibits only slight elasticity in the direction perpendicular to the direction of stretch. When such materials are used, the rectangular stretch panel should be cut so that the stretch takes place along a line perpendicular to the panel's long edge.

Referring to FIGS. 2 and 3, along the free edge of stretch panel 15, an elastic band 23 is attached. This band can be of any suitable stretch material and the elastic that is commonly used by seamstresses is preferred. When such a band is used, the length of the elastic band should be approximately seventy to eighty percent of the length of the rectangular stretch panel. This ratio of elastic band length to stretch panel length will vary depending upon the particular elastic band used. However, the ratio is readily determinable and will present no problem to one skilled in the art. The free edge of the stretch panel is tucked or gathered at intervals along the stretch panel. Typically, the tucks will occur at two inch intervals along the elastic band and the free edge of the stretch panel is thus evenly distributed along the elastic band. Thus, when the sheet is placed over the mattress, the stretch panel is fully extended and the elastic band is stretched providing tension along the free edge of the stretch panel. This tension holds the free edge of the stretch panel securely under the end of the mattress. In addition, the elastic band tends to pull the free edge of the stretch panel into place under the mattress when the sheet is being placed on the bed.

The action of the elastic band and of the stretch panel combine to mold the box-like construction of the sheet to the foot and head ends of the mattress. The combination results in the sheet being held firmly in place. The combination allows a secure fit while allowing the bed to be made with ease. Little or no lifting is required to place the sheet securely on the mattress. The unique construction allows the user to pull the sheet over the mattress with little effort and the combination of forces created by the mode of construction and materials used tends to pull the free edges of the stretch panel into place under the mattress and to mold the sheet to the shape of the mattress ends. The sheet design due to its inherent stretch properties also compensates for any mismatch between the size of the sheet and the size of the mattress.

Although the above description has been directed to a bottom sheet, a similar article can be manufactured that is suitable for use as a mattress cover or boxspring cover. While the design is the same, one skilled in the art will recognize that different materials may be more suitable for use in a mattress cover. For example, the fabric panel 13 can be a heavier quilted material or a waterproof fabric or material. Such variations in material are within the scope of the invention.

Figure 4:
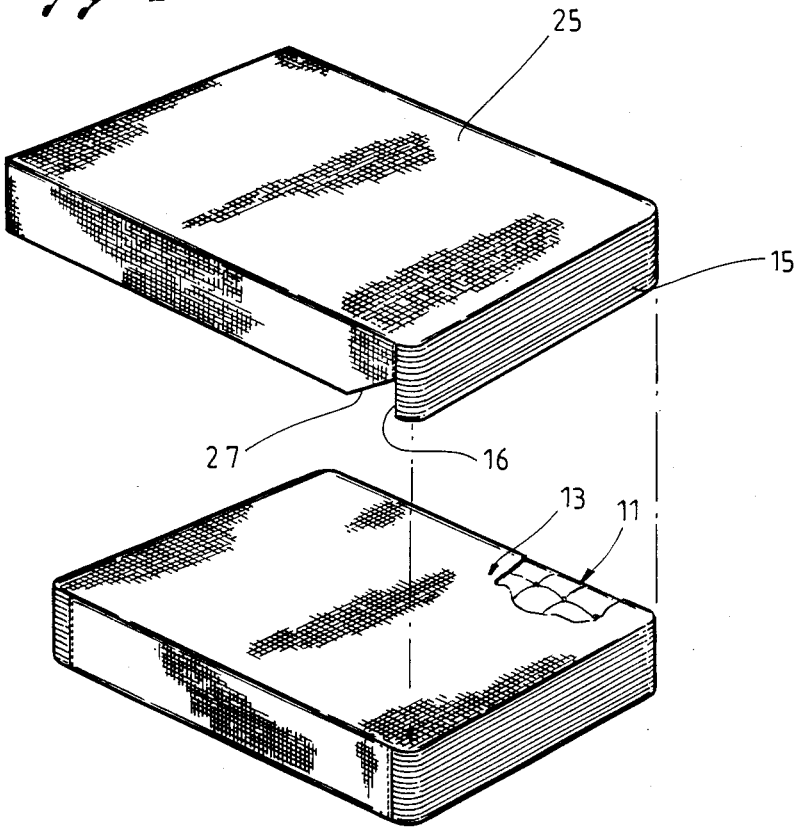
FIG. 4 is an exploded view of a top sheet and mattress covered by a bottom sheet.
Figure 5:
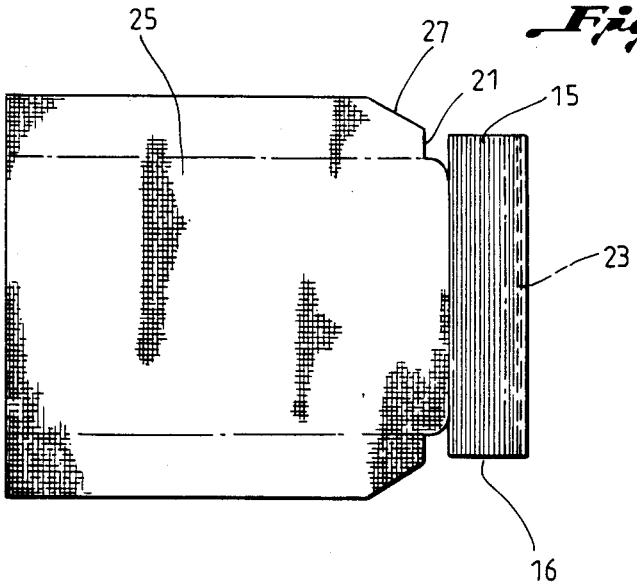
FIG. 5 is a view of the fabric panel and stretch panel prior to the attachment of the ends of the stretch panels to the fabric panel.

FIG. 4 illustrates the innovative concept of the invention as applied to a top sheet or blanket. The stretch panel 15 is attached at only the foot end of the sheet leaving the head end free. The construction of the foot end of the bedding article is similar to that described above. The sheet or blanket panel 25 is cut five to six inches below its juncture with the upper corner of the stretch panel 15 along an angled line 27 allowing for a neat appearance and movement and comfort in the foot area. Although only one end of the bedding article utilizes the novel securing system, the sheet or blanket is held securely in place on the mattress during use. The novel construction and combination of materials provide this secure fit and also provide greater room and comfort in the foot area.

Figure 6:
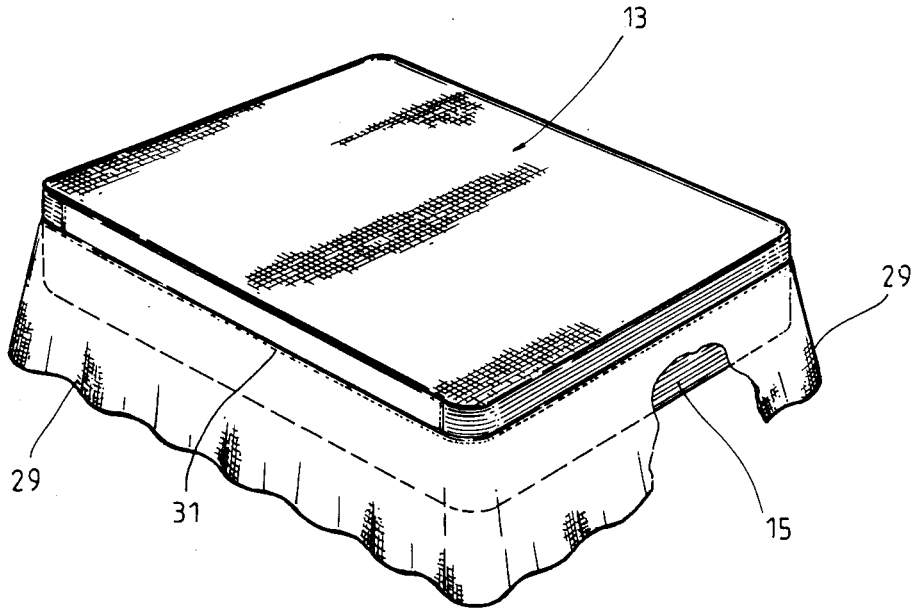
FIG. 6 is a view of a mattress cover with a dust cover attached.

The invention can be adapted to a variety of other articles of bedding. Among these are boxspring covers, bedspreads and comforters. The invention is, for example, well adapted to box spring covers. Various decorative items such as dust ruffles can also be added to the various articles. FIG. 6 illustrates the inventive concept as applied to a box spring cover. The stretch fit ends of the box spring cover are as described above. A dust ruffle 29 is attached to the box spring cover so as to be about two to four inches below the top of the box spring when the cover is in place. The dust ruffle thus positioned does not interfere with bed making as do normal dust ruffles.

Other modifications and variations will be apparent to those skilled in the art and are intended to be within the scope of the appended claims.

What is claimed is:

1. A bedding article for use with a rectangular mattress, having opposing head and foot ends, comprising:

a fabric panel of substantially rectangular shape nominally exceeding the width of the mattress, measured parallel to said head and foot ends, plus twice the depth of the mattress in width, said fabric panel having at each corner of said foot end substantially rectangular cutouts forming at each foot end corner a first edge non-parallel to the foot end of said fabric panel and a second edge parallel to said foot end;

a substantially rectangular stretch panel having two long sides and two ends attached along one long side to the foot end and to said first edges of said fabric panel and along each end of said stretch panel to said second edges of said fabric panel so as to form a box-like construction defined on the top and each side by said fabric panel and on the end by said stretch panel wherein said stretch panel extends a nominal distance beyond the corners of said box end.

2. The article of claim 1 wherein said bedding article is a top sheet.

3. The article of claim 1 wherein said bedding article is a blanket.

4. The article of claim 1 wherein an elastic band is attached along the free side of said stretch panel.

5. A bedding article for use with a rectangular mattress having opposing head and foot ends comprising:

a fabric panel of substantially rectangular shape nominally exceeding the width of said mattress, measured parallel to said head and foot ends, plus twice the depth of the mattress in width, said fabric panel having at each corner of said foot and head ends substantially rectangular cut outs forming at each corner a first edge non-parallel to said foot and head ends and a second edge parallel to said foot and head ends;

a first substantially rectangular stretch panel having two long sides and two ends attached along one long side to the foot end and to said first edges at said foot end of said fabric panel and along each end of said stretch panel to said second edges of said fabric panel so as to form a box-like construction defined on the top and each side by said fabric panel and on the end by said stretch panel wherein said stretch panel extends a nominal distance beyond the corners of said box end;

a second substantially rectangular stretch panel attached to the head end of said fabric panel in the same manner as the first stretch panel is attached to the foot end.

6. The article of claim 5 wherein said bedding article is a bottom sheet.

7. The article of claim 5 wherein said bedding article is a mattress cover.

8. A bedding article for use with a rectangular box spring having opposing head and foot ends comprising:

a fabric panel of substantially rectangular shape nominally exceeding the width of said box spring, measured parallel to said head and foot ends, plus twice the depth of the box spring in width, said fabric panel having at each corner of said foot and head ends substantially rectangular cut outs forming at each corner a first edge non-parallel to said foot and head ends and a second edge parallel to said foot and head ends;

a first substantially rectangular stretch panel having two long sides and two ends attached along one long side to the foot end and to said first edges at said foot end of said fabric panel and along each end of said stretch panel to said second edges of said fabric panel so as to form a box-like construction defined on the top and each side by said fabric panel and on the end by said stretch panel wherein said stretch panel extends a nominal distance beyond the corners of said box end;

a second substantially rectangular stretch panel attached to the head end of said fabric panel in the same manner as the first stretch panel is attached to the foot end.

9. The article of claim 8 wherein a dust ruffle is attached to said mattress cover so that said dust ruffle is below the top of said box spring when said mattress cover is in place.

* * * * *